United States Patent [19]

Roeder

[11] 4,032,266

[45] June 28, 1977

[54] VALVE ASSEMBLY FOR RECIPROCATING DOWNHOLE PUMPS

[76] Inventor: George K. Roeder, P.O. Box 4335, Odessa, Tex. 79760

[22] Filed: Apr. 16, 1976

[21] Appl. No.: 677,537

[52] U.S. Cl. ..... 417/571; 137/512

[51] Int. Cl.[2] ..... F04B 39/10; F16K 21/04

[58] Field of Search ..... 137/512; 417/564, 563, 417/571

[56] References Cited

UNITED STATES PATENTS

| | | | |
|---|---|---|---|
| 2,081,222 | 5/1937 | Coberly | 417/571 |
| 2,932,312 | 4/1960 | Roeder | 137/512 |
| 3,370,545 | 2/1968 | Waibel | 417/571 |

*Primary Examiner*—John J. Vrablik
*Assistant Examiner*—G. P. LaPointe
*Attorney, Agent, or Firm*—Marcus L. Bates

[57] ABSTRACT

A valve device for controlling fluid flow into and out of the working chamber of a reciprocating pump. A valve body axially receives the pump connecting rod and includes circumferentially extending, alternately arranged, intake ports and exhaust passageways. Seats are formed on opposed sides of the main body, and a spring-loaded plate abuttingly engages the seats.

An outwardly directed annulus circumferentially extends about a central,, marginal portion of the main body and communicates with the inlet port by means of an outwardly directed cavity which is formed by milling a crescent-shaped portion of a cylinder having an outer peripheral edge portion which intersects the centerline of a vertically disposed, constant diameter port, while the centerline of the axial passageway, port, and cylinder lie along a common line drawn normally to the longitudinal central axis of the valve body.

This configuration of a valve assembly provides a main body having increased structural integrity and improved flow characteristics.

8 Claims, 10 Drawing Figures

VALVE ASSEMBLY FOR RECIPROCATING DOWNHOLE PUMPS

BACKGROUND OF THE INVENTION

Downhole, hydraulically actuated, pumping apparatus generally include a hydraulically actuated engine which reciprocates a piston associated with a downhole pump so that production fluid enters the pump working chamber and is forced towards the surface of the earth along with spent power fluid from the engine. Hydraulically actuated, downhole pumps are very complex in design and are usually made for operation in deep, slim boreholes; and therefore, very little latitude is available to the pump manufacturer in selecting dimensions for the various mechanical components of the intricate engine and production pump mechanism.

In my previously issued U.S. Pat. No. 2,932,312, there is disclosed a valve system for pumps, which constitutes an improvement over the Coberly U.S. Pat. No. 2,081,222. Reference is made to these two previously issued patents for further background of this invention. In each of these two previously issued patents, there is disclosed a valve structure in the form of a circular hub which has an intake port formed therein by the formation of two intersecting constant diameter counterbores, with one of the counterbores being vertically disposed and located circumferentially spaced from the axial bore which receives the connecting rod therethrough, and with the remaining counterbore being normally arranged and radially disposed respective to the first counterbore. This configuration results in a considerable reduction in the structural integrity of the main valve body, because of the amount of material which must be removed from between the opposed faces of the valve body. Furthermore, the flow characteristics of the intake fluid flowing therethrough "washes out" interior portions of the valve assembly, especially since the production fluid often carries significant amounts of entrained, abrasive, foreign material during the pumping action.

The reduction in structural integrity resulting in the formation of the radial portion of the intake ports often leads to the formation of radial cracks which occur in the outer marginal edge of the valve structure in proximity of the intake ports, thereby rendering the pump inefficient in operation and sometimes inoperative. Furthermore, the undesirable flow characteristics imparted by the constant diameter radial counterbore contributes to maintenance problems. It is therefore desirable to provide a downhole, hydraulically actuated pump of a reciprocating type with improvements in the valve assembly associated therewith which exhibits increased structural integrity along with improved flow characteristics, so that the life of the entire system is significantly prolonged.

SUMMARY OF THE INVENTION

An improved valve device for use in the production end of a hydraulically actuated, downhole pump assembly. The valve device includes a novel main body made into the form of a circular hub, having an upper and lower face, an axial bore for sealingly receiving the pump piston rod therethrough in a reciprocating manner, a plurality of radially spaced-apart axial passageways extending through the hub in alternate relationship respective to a plurality of radially spaced-apart ports which extend axially only partially through the hub, and then turn normal to the axial bore.

An outwardly directed annulus is formed about an outer sidewall surface of the hub and includes radially spaced segments of a cylinder connected to each of the ports so that fluid flows from the annulus, through the segmented cylindrical port, up through the axial port, into the working chamber of the production pump, while produced fluid from the working chamber flows back through the axial passageways of the main body and then out of the pump assembly.

Opposed spring-loaded valve closure members sealingly engage a standoff seat formed on each opposed face of the main body to thereby form a check valve assembly so that fluid must by pumped from the annulus, through the valve main body, into the working chamber, and back through the valve main body, as the production pump piston is reciprocated by the engine piston.

The segment of the cylinder is formed by milling a crescent-shaped passageway which is at least three times in diameter respective to the diameter of the counterbore of the port, with the outer periphery of the cylinder intersecting the axial centerline of the counterbore of the port, and with the centerline of the cylinder, counterbore, and axial rod-receiving bore each lying along a common radial line drawn normally to the axial bore.

Accordingly, a primary object of the present invention is the provision of a valve device having improved structural integrity imparted thereinto as a result of the configuration of the intake port associated therewith.

Another object of the invention is to provide improvements in the flow characteristics of fluids flowing through a valve device associated with a reciprocating pump.

A further object of this invention is to disclose and provide an improved valve device for a reciprocating pump which controls the flow of fluid into and out of pump mechanism in response to reciprocation of a pump piston associated therewith.

A still further object of this invention is the provision of an improved main body for a valve assembly associated with a reciprocating pump.

Another and still further object of this invention is the provision of a valve body having a flow port made into a configuration which increases the structure adjacent to the end of the port while at the same time improving the flow characteristics of the fluid flowing through the port.

An additional object of the invention is to provide a valve body having a flow port made into a geometrical configuration which reduces the frequency with which flaws occur within the body, while promoting the resistance to abrasive action of fluids flowing through the body.

These objects are obtained by the provision of a valve body which has a port formed by an annulus connected to a vertical counterbore by a horizontal milled crescent.

These and other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
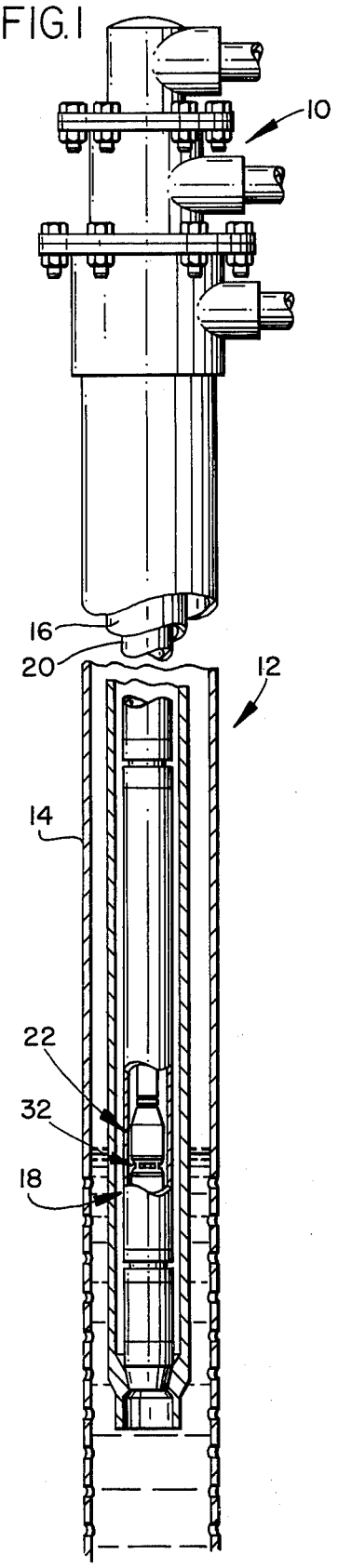
FIG. 1 is a broken, part cross-sectional, longitudinal view of a wellbore having a downhole, hydraulically actuated pump assembly associated therewith.

In FIG. 1 there is illustrated a wellhead 10 connected to a borehole 12 which extends down into the earth and is usually provided with a casing 14. The well includes a production tubing 16 within which there is disposed a downhole, hydraulically actuated pump assembly 18.

Power oil tubing 20 extends from the wellhead down to the engine associated with the pump in the usual manner. Numeral 22 broadly indicates the production end of the pump assembly.

Figure 2:
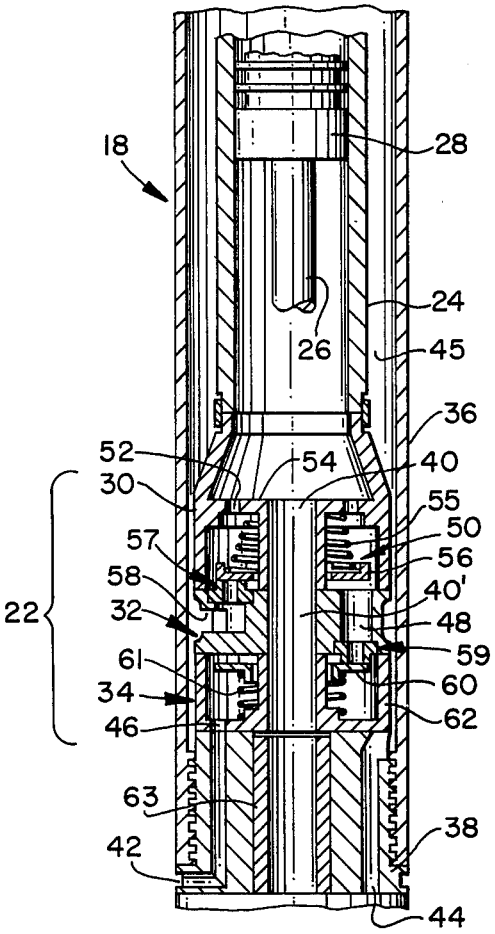
FIG. 2 is an enlarged, fragmentary, part cross-sectional view showing the details of part of the apparatus disclosed in FIG. 1.

As seen in FIG. 2, the production end of the downhole pump assembly includes a pump barrel 24, which can take on several different forms, and which includes a connecting rod 26 connected to a pump piston 28 of conventional design.

The pump barrel is connected to a sub assembly which includes an upper housing 30, a valve plate 32 made in accordance with the present invention, and a lowe housing 34. The pump housing includes upper housing portion 36 which threadedly engages lower sub 38 so that the entire apparatus can be conveniently disassembled. Axial bore 40 longitudinally extends through the valve assembly at 40′ so that rod 26 is reciprocatingly received axially therethrough in a sealed manner.

Produced fluid outlet 42 is flow connected to the production tubing annulus while formation fluid inlet 44 is connected to the pump inlet and to the annulus 45, thereby providing the suction side of the pump valve assembly with a source of formation fluid. The housing 34 includes an outlet 46 which is flow connected to the before mentioned outlet 42.

As seen disclosed in various figures of the drawings, the valve assembly of the present invention is provided with a plurality of longitudinal outlet passageways 48 circumferentially arranged to respective to one another and radially arranged respective to the central or axial bore 40′ so that fluid can flow from the interior 50 of housing 30, through the longitudinal passageway. Inlet port 52 connects cavity 50 of the upper housing with the lower extremity 54 of the working chamber of the production pump. Biasing means in the form of a coil spring 55 biases a valve plate 56 into seated engagement respective to a plurality of upstanding valve seats 57, hereinafter referred to as "standoff valve seats".

A plurality of outwardly directed, radially spaced-apart ports 58 are in fluid communication with annulus 45. A plurality of standoff valve seats 59 form the lower end portion of longitudinal passageway 48 and sealingly receive valve element 60 thereagainst in proportion to the force exerted by a biasing means 61, which is the form of a coil spring located within cavity 62 of the lower housing 34, also referred to herein as a lower valve spring cage. Cylindrical bushing 63 sealingly engages a marginal length of the reciprocating piston rod.

Figure 3:
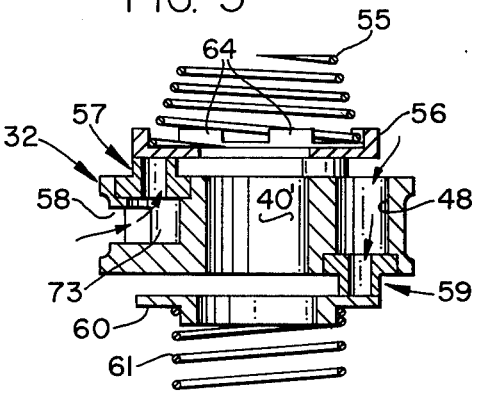
FIG. 3 is a further enlarged, hypothetical cross-sectional view taken at 450 in order to show both the inlet and outlet passageways in a single view.
Figure 4:
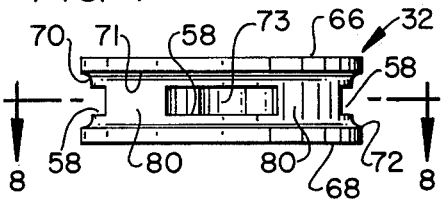
FIG. 4 is a side elevational view of part of the apparatus disclosed in FIG. 3.
Figure 5:
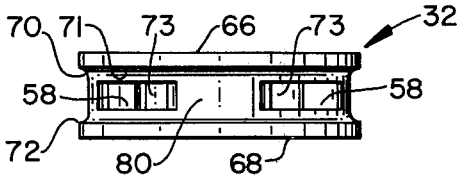
FIG. 5 is a side elevational view of the apparatus disclosed in FIG. 4, with the apparatus being axially rotated.
Figure 6:
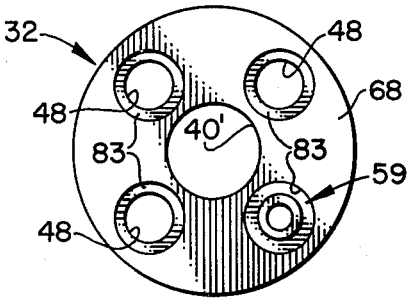
FIG. 6 is a bottom view of the apparatus disclosed in FIGS. 4 and 5.
Figure 7:
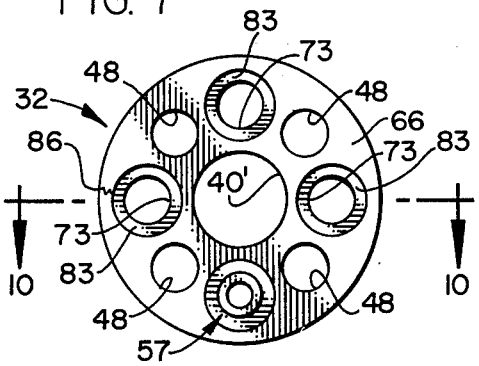
FIG. 7 is a top view of the apparatus disclosed in FIGS. 4 and 5.
Figure 8:
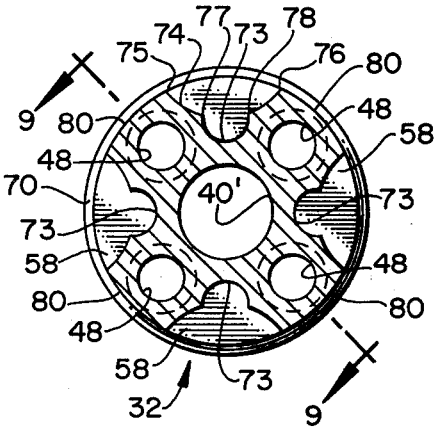
FIG. 8 is a cross-sectional view taken along line 8—8 of FIG. 4.
Figure 9:
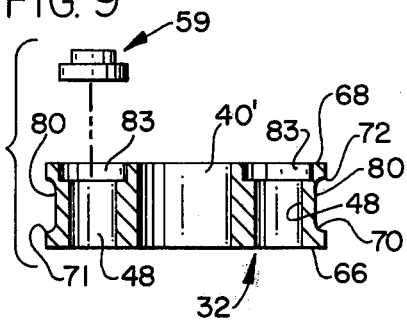
FIG. 9 is a cross-sectional view taken along line 9—9 of FIG. 8.
Figure 10:
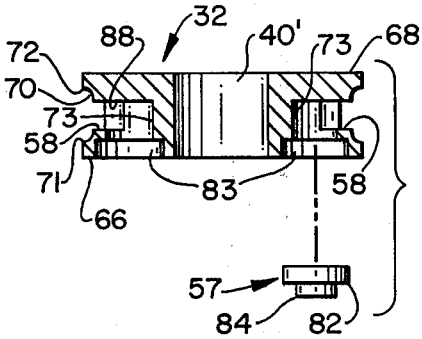
FIG. 10 is an inverted, cross-sectional view taken along line 10—10 of FIG. 7.

As best seen illustrated in FIG. 3, in conjunction with other figures of the drawings, the valve element 56 is provided with upturned ears 64, thereby capturing the lower end of spring 55 such that the lower face of plate 56 sealingly engages the upper face of the standoff seats to provide a fluidtight seal therebetween. The lower valve plate element similarly engages the lower face of the standoff seats and a boss is provided on the valve plate for capturing the upper end portion of the spring 61.

As seen illustrated in FIGS. 4–7, the valve assembly of the present invention is in the form of a circular hub, and is provided with an upper face 66 spaced from a lower face 68, with the faces preferably being parallel to one another. A circumferentially extending annulus is formed about a midportion of the main valve body or hub member by undercutting the midportion thereof to form a reduced diameter, outwardly opening, annular area 70 which is curved back into the body to form the outer peripheral wall surface of the hub-like membr at 70 and 72. The inlet port comprises two vertical counterbores 73 which are of constant diameter and which receive the standoff valve element 57 by press fitting the boss of the element within the enlarged diameter portion formed at the marginal upper end portion thereof.

An outwardly directed cavity is formed along a radius 74 by milling into the body at a location which is between and equally spaced from edges 71, 72, such that the circumference 74 intersects the axial centerline of counterbore 73, with the axial centerline of the milling tool being positioned along a line drawn radially through the axial centerline of port 73 and axial bore 40. The milled slot commences at 75 and ends at 76 while intersecting edge portions 77 and 78 of the opposed walls of the port 73.

The milled slots are of thickness which is considerably less than the diameter of the port and are spaced apart from one another to leave area 80, through which the before mentioned longitudinal passageways are formed. This expedient provides ample structure for formation of the longitudinal passageways and the enlarged diameter portion 83 which receives the upstanding valve seat therewithin. Numeral 82 indicates the boss, or large outside diameter, of the valve seat, while numeral 84 defines the reduced diameter portion which terminates in a smooth surface for engaging the biased valve plate.

Numeral 86 indicates the thinnest section associated with the main body member of the present invention. This is the area where fatigue cracking is most liable to occur. One purpose of the present invention is the elimination of fatigue cracking in the area indicated, while at the same time, improving the flow characteristics of fluids flowing through the intake ports.

The closure plate 56 and valve element 60 are examples of closure means which can be used in conjunction with the present invention. Where deemed desirable, a spring loaded ball check valve can be advantageously used for the closure means of each of the standoff valve seats. Hence, the term "closure means" as used in the claims is intended to include both a valve plate, a ball check valve, as well as other means by which unidirectional flow is achieved through each of the valve seats associated with the main body.

During assembly wherein the standoff valve seat is mated to the main body, it is preferable to heat the main body to above 1000° F. to expand the counterbore 83 so that the boss 82 of the standoff valve seat can be properly mated with the main body. The interface between the main body and the valve seat is usually silver soldered at this time. In the prior art valve device, cracking at 86 often occurs as the assembled apparatus cools to room temperature. The unique design of the crescent-shaped inlet port provides greater structural integrity at the area where this deleterious cracking was liable to occur and hence the present invention obviates the heretofore tendency toward this defect.

IN OPERATION

As the engine reciprocates the pump piston 28, rod 26 reciprocates within axial bore 40' and intake or formation fluid is available at 44 and 45, while produced fluid is exhausted from the pump at 42. The piston upstrokes and downstrokes while the opposed biased valve plates alternately are forced from the corresponding upstanding seats so that fluid is forced to flow into and out of the working chamber in response to reciprocation of the pump piston. Hence the combination of the improved valve structure of the present invention can be used in hydraulically actuated pumps of a reciprocatory nature having a connecting rod which is connected to another piston located further below the valve assembly 32, or alternatively, the rod at 26 may be a stinger which extends down through bushing 63 so that fluid pressure is available at the end thereof for providing an upward thrust in accordance with my previous patent application, Ser. No. 632,550, filed Nov. 17, 1975.

The valve structure of the present invention forms a closure member at the lower end of the pump barrel to form a working chamber, with the rod 26 being brought axially through the valve structure, while fluid flows into the working chamber by means of the spaced intake ports at 58. The fluid flows out of the working chamber by means of the spaced passageways 48 formed in the valve structure. The valve structure includes opposed faces 66 and 68, with the before mentioned passageways being parallel to the axial bore 40', and a standoff valve seat 59 being affixed to one end 83 of each of the passageways. A closure means in the form of plate 60 concurrently closes against each seat 59 to prevent flow into the lower chamber 62. Spaced ports 73 are formed in the valve structure, and the valve structure includes a reduced diameter midportion 58 which forms an outwardly directed, circumferentially extending annular area about a medial edge portion of the valve structure. The intake ports include a counterbore 73 extending part of the way through the valve structure into proximity of, but spaced from, said lower face 68. A segment of a cylinder 74, 75, 76, 78 having an inside diameter at least three times the inside diameter of the counterbore 73, with the outer periphery 74 of the cylinder intersecting the axial centerline of the counterbore, forms an outwardly directed cavity which flow connects the annular area with the counterbore, and hence with the corresponding upstanding valve seat. The segmented, cylindrical, outwardly directed cavity is of a height which is substantially less than the diameter of the counterbore and approximately one-third the height of the main body, thereby leaving ample material to prevent the occurrence of fatigue cracks, while at the same time, the area remaining between the segmented cylinder and counterbore is sufficiently large enough to avoid undue pressure drops of fluids flowing therethrough. In any event, the smallest cross-sectional area measured between the segmented cylinder and the vertical counterbore should not be less than the cross-sectional area presented by the inside diameter of the standoff valve seat.

Moreover, by connecting the counterbore to the annular area by means of the segmented, cylindrical, outwardly directed flow chamber in accordance with the present invention, the unexpected result of reduction in wear due to impingement and excessive turbulence as fluid flows through the port is achieved. Hence the configuration of the valve body reduces the effect of abrasive particles which may be entrained within the formation fluid as it flows through the valve element.

The avoidance of fatigue cracks, along with the improved flow path presented by the present invention, provides a valve assembly which exhibits a longer life, as well as improved operating characteristics.

I claim:

1. In a hydraulically actuated, downhole pump assembly having an engine which reciprocatingly drives a production pump piston within a pump barrel, with the pump piston being connected to the engine by a connecting rod, the combination with said pump piston and rod of a valve device which controls the flow of production fluid into and out of the pump barrel;

said valve device being a main body having the form of a circular hub, said main body having an upper and a lower face which are opposed respective to one another and spaced apart by a sidewall of said main body; a central, marginal, circumferentially extending portion of said sidewall being reduced in diameter to form an annulus about said main body; an axial bore for sealingly receiving the rod therethrough in a reciprocating manner, and a plurality of circumferentially spaced passageways extending through the main body such that the axial centerline thereof is parallel to and radially spaced from the axial centerline of said axial bore;

means forming a standoff exhaust valve seat on said lower face at the end of each said passageway; a closure means for each said seat, means by which said closure means is resiliently biased into abutting engagement concurrent with the free end of each said seat;

means forming a plurality of circumferentially spaced intake ports which include a counterbore which extends parallel to said radially spaced passageways and extend only partially through said main body and then radially outward into communication with said annulus, the axial centerline of said counterbore being aligned along a circumference which intersects the axial centerline of said passageways, with one said port being located between any two adjacent passageways;

the radially outwardly directed portion of said ports being a segment of a cylinder which has a diameter three times greater than the diameter of said counterbore, with the outer circumferential wall of said cylinder intersecting the axial centerline of said counterbore, and the height of said cylinder being one third the thickness of said circular hub; and with the axial centerline of said cylinder being located along a line drawn from the axial centerline of said axial bore and said counterbore; and, means forming a standoff intake valve seat on said upper face at the end of said counterbore; a closure means for each said valve seat, means by which said closure means is resiliently biased into abutting engagement concurrent with the free end of each of the last said seats.

2. The valve device of claim 1 wherein there are four passageways and four intake ports, the diameter of said cylinder being four times the diameter of said counterbore;

said segment having circumferentially spaced edges which terminate in said annulus so that fluid flows into said annulus, into said segment, through said port, and to said standoff valve seat.

3. The valve device of claim 1 wherein the cross-sectional area of the flow path where said segment joins said counterbore is of a value which is at least as great as the cross-sectional area of the flow path formed through said standoff intake valve seat.

4. The valve device of claim 1 wherein there are four passageways and four ports, the diameter of said cylinder being four times the diameter of said counterbore;

said segment having circumferentially spaced edges which terminate in said annulus so that fluid flows into said annulus, into said segment, through said port, and to said standoff valve seat;

the cross-sectional area of the flow path where said segment joins said counterbore is of a value which is at least as great as the cross-sectional area of the flow path formed through said standoff intake valve seat.

5. In a production pump assembly of the reciprocating type, wherein the pump assembly includes a barrel within which a piston is reciprocated by a connecting rod, and a valve structure forms a closure member at one end of the barrel to form a working chamber, with the rod being brought axially through an axial bore formed through the valve structure so that the rod reciprocates in sealed relationship therewith, while fluid flows into said working chamber by means of intake ports formed within said valve structure and out of said working chamber by means of spaced outlet passageways formed in said valve structure; the improvement comprising:

said valve structure having opposed faces and a circumferentially extending sidewall between said opposed faces, said passageways being circumferentially spaced apart and formed through said valve structure and parallel to said axial bore, a standoff valve seat affixed to one end of each said passageway; a closure means for concurrently closing against each said seat to permit flow from and prevent flow into the working chamber;

said intake ports being circumferentially spaced apart and formed in said valve structure with there being one port between adjacent said passageways;

said valve structure having means forming a reduced diameter midportion which forms an outwardly directed, circumferentially extending annular area about a medial portion of said sidewall of said valve structure;

said intake ports including a counterbore extending only part of the way through said valve structure and into proximity of but spaced from said lower face; said intake ports further including a segment of a cylinder having an outside diameter at least three times the inside diameter of said counterbore, with the outer periphery of the segment of the cylinder intersecting the axial centerline of the counterbore to form an outwardly directed cavity which outwardly enlarges to flow connect said annular area with said counterbore; said valve structure having a height measured between said faces which is three times the height of said segment of said cylinder;

the outlet end of said intake port having a standoff valve seat formed thereon, and a closure means received against the free end of the standoff valve seat for controlling the flow of fluid into the working chamber.

6. The improvement of claim 5 wherein there are four passageways and four intake ports, the diameter of said cylinder being four times the diameter of said counterbore;

said segment having circumferentially spaced edges which terminate in said annulus so that fluid flows into said annulus, into said segment, through said port, and to said standoff valve seat.

7. The improvement of claim 5 wherein the cross-sectional area of the flow path where said segment joins said counterbore is of a value which is at least as great as the cross-sectional area of the flow path formed through said standoff intake valve seat.

8. The improvement of claim 5 wherein there are four passageways and four ports, the diameter of said cylinder being four times the diameter of said counterbore;

said segment having circumferentially spaced edges which terminate in said annulus so that fluid flows into said annulus, into said segment, through said port, and to said standoff valve seat;

the cross-sectional area of the flow path where said segment joins said counterbore is of a value which is at least as great as the cross-sectional area of the flow path formed through said standoff intake valve seat.

* * * * *

UNITED STATES PATENT OFFICE

CERTIFICATE OF CORRECTION

PATENT NO. : 4,032,266

DATED : June 28, 1977

INVENTOR(S) : GEORGE K. ROEDER

It is certified that error appears in the above-identified patent and that said Letters Patent are hereby corrected as shown below:

Column 2, line 15, substitute --be-- for "by";

Column 2, line 39, after "of" (second occurrence) insert --a--;

Column 3, line 47, correct the spelling of "lower";

Column 3, line 64, cancel "to" (first occurrence);

Column 4, line 12, after "is" insert --in--;

Column 7, line 14, after "of" insert --each--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*